US005591907A

United States Patent [19]

Stein et al.

[11] Patent Number: 5,591,907

[45] Date of Patent: Jan. 7, 1997

[54] WEATHERPROOF SENSING APPARATUS WITH ROTATABLE SENSOR

[75] Inventors: Peter J. Stein, Hollis, N.H.; Armen Bahlavouni, Waltham, Mass.; Michael G. Fitzgerald, Wilmington, Mass.; Douglas W. Andersen, Acton, Mass.

[73] Assignee: Scientific SOlutions, Inc., Hollis, N.H.

[21] Appl. No.: 502,219

[22] Filed: Jul. 13, 1995

[51] Int. Cl.[6] ..... G12B 9/00

[52] U.S. Cl. ..... 73/170.16

[58] Field of Search ..... 248/288.31, 288.51; 73/170.16, 170.17, 170.18, 170.19, 170.21, 170.26, 170.25, 431

[56] References Cited

U.S. PATENT DOCUMENTS

| | | | |
|---|---|---|---|
| 3,429,185 | 2/1969 | Piper et al. | 73/756 |
| 4,043,686 | 8/1977 | Hackett . | |
| 4,628,732 | 12/1986 | Makinen . | |
| 4,702,449 | 10/1987 | Zierhut . | |
| 5,186,050 | 2/1993 | Lagace et al. . | |

*Primary Examiner*—Richard Chilcot
*Assistant Examiner*—Ronald L. Biegel
*Attorney, Agent, or Firm*—Davis and Bujold

[57] ABSTRACT

A sensing apparatus, for use in adverse conditions comprising a housing having an aperture formed therein. A generally spherically shaped housing, which is larger in size than the aperture, partially extends through the aperture. The generally spherically shaped housing supports a desired sensor and is supported for rotation about an axis of rotation. A drive mechanism is provided for rotating the generally spherically shaped housing to and fro about its rotational axis from a use position, in which the sensor is positioned outside the housing to obtain sensor measurements, to a retracted position in which the sensor is completely accommodated within the housing and sheltered from the elements. A peripheral scraping ring is mounted circumferentially about the aperture in close proximity to an exterior surface of the generally spherically shaped housing but spaced therefrom. The scraping ring is positioned to remove any snow, ice, rain, freezing rain, moisture, dirt, soot, or other contaminants contained on the exterior surface of the generally spherically shaped housing during rotation thereof. The sensing apparatus also includes fans, a calibration device and a heater to maintain the sensor in an operable condition.

20 Claims, 6 Drawing Sheets

WEATHERPROOF SENSING APPARATUS WITH ROTATABLE SENSOR

FIELD OF THE INVENTION

This invention relates to a weatherproof sensing apparatus, and more particularly to a sensing apparatus for use in severe inclement weather.

This invention was made with Government support under contract No. N00014-95-C-0086 awarded by the Department of the Navy. The Government has certain rights in this invention.

BACKGROUND OF THE INVENTION

It is known in the art to mount sensors such as radiometers in a housing. The orientation of the sensor in the housing is such that the sensor is always located outside of the housing in a ready for use position. The housing does not allow the sensor to be rotated so that the sensor is completely accommodated within the housing and sheltered from the environment.

Sensors used to collect data are subjected to the elements, e.g. ice, snow, rain, freezing rain, wind, and moisture as well as dirt, soot, mud, contaminants, etc. which will typically hinder proper operation of the sensor. Such naturally occurring and/or man made elements and contaminants can accumulate on the sensor and restrict the function of the sensor or cause the sensor to malfunction. Further, the prior art housing designs do not provide for the removal of accumulated ice, snow, moisture, dirt or the like.

The term "generally spherically shaped housing", when used below and in the appended claims, includes any spherically shaped member such as generally cylindrical members, generally ovoid shaped members, and/or generally egg shaped members, as well as any partial or truncated generally cylindrical members, partial or truncated generally ovoid shaped members, and/or partial or truncated generally egg shaped members, including modifications thereof. In particular, that term is intended to cover any and all members which: 1) have an axis extending longitudinally thereof, and 2) have a plane extending normal to the longitudinal axis of the member and extending through the member, defining a circle, if the generally spherically shaped member is not truncated, or a portion of a circle, if the generally spherically shaped member is truncated. The term "generally spherically shaped area", when used below and in the appended claims, means the total area defined by the generally spherically shaped member in a non-truncated form, i.e. the area the entire untruncated generally spherically shaped member would occupy.

SUMMARY OF THE INVENTION

Wherefore, it is an object of the present invention to overcome the aforementioned problems and drawbacks associated with the prior art designs.

It is also an object of the present invention to provide a main cylindrical housing for the sensor which allows the sensor to be rotated so that it is totally and completely accommodated within the main cylindrical housing in order to protect the sensor from the elements as well as other environmental contaminants.

Another object of the invention is to provide a sensing apparatus with the capability of removing contaminants, e.g. ice, snow, rain, freezing rain, soot, dirt, and moisture from an exterior surface of the generally spherically shaped housing during rotation of the sensing apparatus.

A still further object of the invention is to provide a mechanism for removing any contaminant(s) from an exterior surface of the sensor, when the sensor is in the storage position, so that the sensor may be rotated to its sensing position.

Yet another object of the invention is to provide a sensing apparatus which can operate properly for extended periods of time, e.g. a year or so, under harsh environmental conditions and/or adverse weather conditions without human intervention.

The invention relates to a sensing apparatus for use in adverse conditions, said sensing apparatus comprising a main housing defining an interior cavity protected from an exterior environment and having an aperture provided in a first surface thereof opening to the environment; and a sensor being supported by a generally spherically shaped housing, said generally spherically shaped housing being larger in size than said aperture and partially extending through said aperture so that at least said sensor is extendible out through said aperture in said main housing for obtaining, when in a use position, sensor measurements; wherein said generally spherically shaped housing is freely rotatable relative to said aperture and is supported by said main housing for rotation about a rotational axis from the use position, in which said sensor is located outside said main housing and positioned to obtain desired sensor measurements, to a retracted position in which said sensor is completely accommodated and protected within said interior cavity of said main housing.

The invention also relates to a method of obtaining sensor measurements in adverse conditions, said method comprising the steps of defining an interior cavity, protected from an exterior environment, in a main housing, and providing an aperture in a first surface thereof opening to the environment; supporting a sensor by a generally spherically shaped housing, said generally spherically shaped housing being larger in size than said aperture, and extending said generally spherically shaped housing partially through said aperture, at least said sensor being extendible out through said aperture in said main housing for obtaining, when desired, sensor measurements; spacing said generally spherically shaped housing from said aperture so as to be freely rotatable relative to said aperture; supporting said generally spherically shaped housing for rotation about a longitudinal axis; rotating said generally spherically shaped housing about the longitudinal axis from one of a use position, in which said sensor is located outside said main housing to obtain desired sensor measurements, to a retracted position in which said sensor is completely accommodated and protected within said interior cavity of said main housing.

The above and other objects of the invention will be further understood, by those skilled in the art, with reference to the following description and the appended drawings.

BRIEF DESCRIPTION OF THE DRAWINGS

The invention will now be described, by way of example, with reference to the accompanying drawings in which.

DESCRIPTION OF THE PREFERRED EMBODIMENTS

Figure 1:
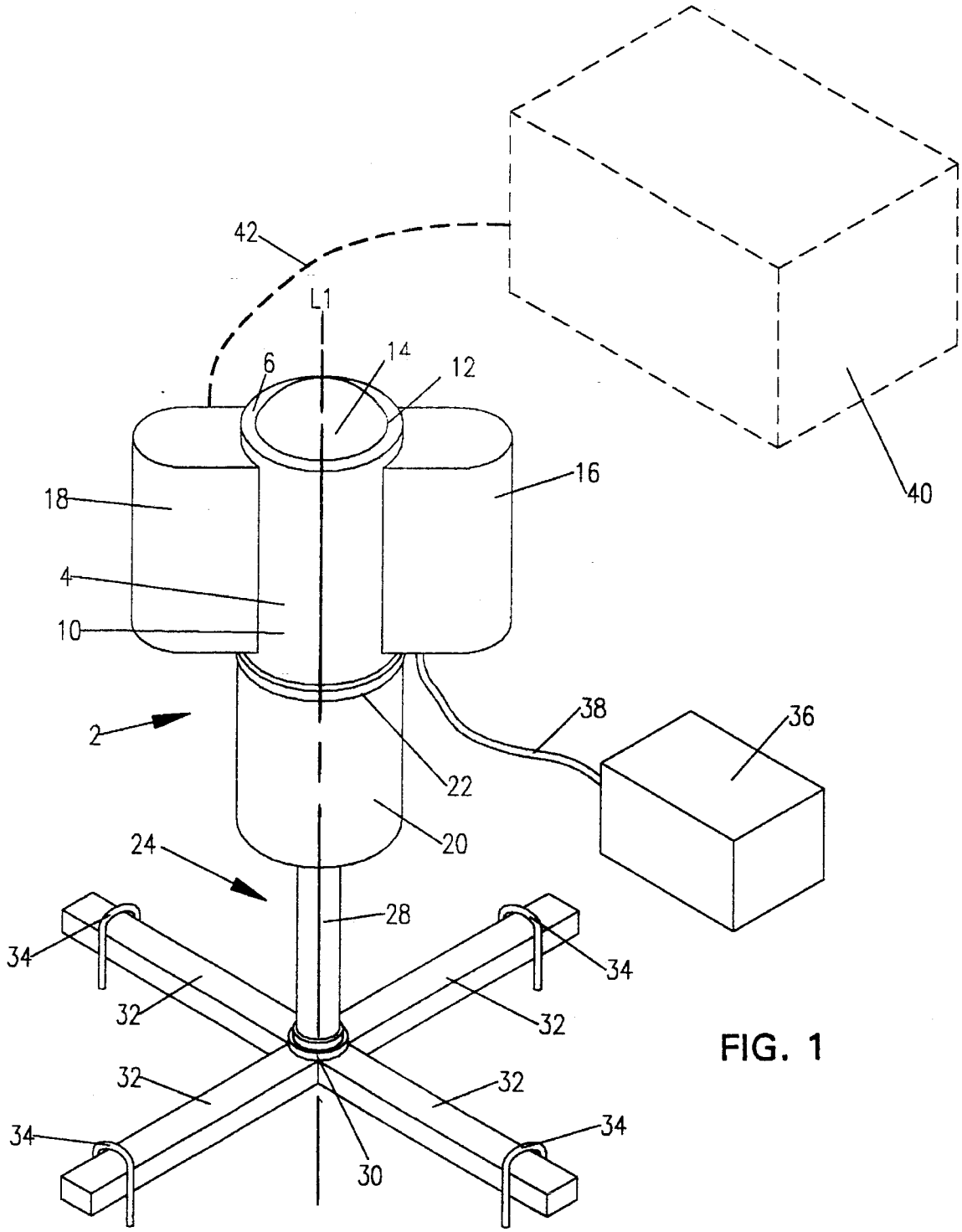
FIG. 1 is a diagrammatic front perspective view of the sensing apparatus according to the invention with the sensor shown in a retracted position.

Turning now to FIGS. 1–4, a detailed description concerning the sensing apparatus according to the present invention will now be provided. The sensing apparatus, generally designated by reference numeral 2, comprises a main generally cylindrical shaped housing 4 having a first upper surface 6 and a cylindrical side surface 10. The cylindrical shaped housing 4 is open at a lower end, opposite the first upper surface 6, to expose the sensing apparatus 2 to ambient air. A circular or ovoid shaped aperture 12, measuring about 5 to 9.5 inches preferably about 8.1 inches, is defined by scraping ring 106 for accommodating a sensor and sensor housing 14, and a further detailed description concerning the same will follow below. The cylindrical housing 4 defines a longitudinal axis L1 of the sensing apparatus 2. The cylindrical housing 4 is between 8 and 14 inches, and preferably 12 inches, in diameter and made of schedule 40 aluminum.

A generally ovoid or spherically shaped sensor housing 14, measuring about 8 to 10.5 inches, is supported within the cylindrical housing 4. The generally spherically shaped sensor housing 14, which is larger in diameter than the aperture 12, partially projects through the aperture 12 as can be seen in FIG. 1. In a preferred embodiment, the generally spherically shaped housing 14 is about 9.5 inches in diameter, is made of aluminum, and has an impregnated hard coating, anodized for ice release. The hard coating may be Teflon®, for example, or any material which will minimize accumulation and/or sticking of contaminants. A drive system housing 16, containing a drive system 62 for the sensing apparatus 2, is secured to the side surface 10 of the cylindrical housing 4, by screws, welding or the like, and a further description concerning the operation and function of the drive system 62 will follow below.

A control system housing 18, containing a control system 121 for the sensing apparatus 2, is also secured to the side surface 10 of the cylindrical housing 4, remote from the drive system housing 16, by screws, welding or the like. A further description concerning the operation and function of the control system 121 will follow below.

A skirt 20 is wrapped around the cylindrical housing 4 and secured thereto by a strap 22, in order to provide protection for the open end of the sensing apparatus 2 from blowing snow, wind, rain, freezing rain, ice, dirt, etc. The strap 22 is preferably made of stainless steel while the skirt 20 is preferably made of ⅛ inch thick, 12 inch wide neoprene rubber.

The cylindrical housing 4 is secured to a stand, generally designated by reference numeral 24, via at least one bracket 26. The bracket 26 is secured to the cylindrical housing 4 in a conventional manner, e.g. by bolts, welding or the like. A threaded bore is provided in a bottom central surface of the bracket 26 for threadingly engaging with a first threaded end of a pipe 28. A second opposite end of pipe 28 threadingly engages with a threaded bore provided in a base flange 30. The flange 30 supports, in a conventional manner, four leg supports 32, preferably unistrut, which extend perpendicular to the longitudinal axis L1 of the sensing apparatus 2. The supports 32 are spaced equally about a plane extending perpendicular to the longitudinal axis L1 of the sensing apparatus 2. The supports 32 are anchored to a desired surface, e.g. the ground, upon which the sensing apparatus 2 rests, by four U-clamps 34.

The pipe 28 preferably has a diameter of about 2.5 inches and is made of schedule 40 galvanized steel. The pipe 28, the flange 30, and the leg supports 32 are preferably all made from galvanized steel or some other suitable metal or rigid material able to withstand harsh environmental conditions and/or adverse weather conditions.

It is to be appreciated that the stand 24 can be of any desired shape or configuration as long as it adequately supports the cylindrical housing 4 on a desired surface. Alternatively, in some applications, the cylindrical housing 4 may rest directly on the ground or some other desired supporting surface thereby obviating the need for a stand.

A power source 36 is provided externally of the sensing apparatus 2. The power source 36 is connected to the drive system 62 and the control system 121 of the sensing apparatus by a pair of power supply cables 38.

The control system 121 of the sensing apparatus 2 is provided in housing 18, and contains a computer 41 for controlling the drive system 62 and for controlling the collection of data from the sensor 86 of the apparatus. The control system 121 is connected to the drive system 62 by at least one cable 42. The computer 41 contains a central processing unit and sufficient logic and memory to facilitate computer control over the rate of data collection from the sensing apparatus 2, to determine the condition of the sensing apparatus 2, to provide error checking, to control operation of the apparatus, etc., as well as any other desired function of the apparatus. Software is provided to control the control system 121 and the software can readily be customized for any specific application.

It is to be appreciated that the sensing apparatus 2 may also include a transmission device, such as a modem or a satellite transmission device, in order to transmit data, status information, a warning message or any other information from the control system 121. The sensing apparatus 2 may also include a receiving device, such as a modem or a satellite reception device, in order to receive instructions, downloaded software or any other information or data from a remote site. Alternatively, a portable external computer 40, e.g. a so called "lap top" computer, may be temporarily connected to the control system 121 by a cable 42 or temporarily connected to the control system 121 by the transmission device and receiving device, at any desired time, to download data from the memory of the control system 121.

The power source 36 is preferably a 12 volt DC battery but may be an AC supply source, solar cells, gel cells, thermal batteries, zinc-air batteries, thermal heat engines or any other desired type of power source suitable for powering the control system 121, the drive system 62, the sensor 86 and the other loads of the apparatus. It is to be appreciated that there may be two separate power sources 36 as the drive system 62, the sensor 86, the calibration device, the heater, the fans, and the control system 121 could be grouped in two groups each powered by a separate power source of sufficient electrical power. An important aspect of the invention is that there is sufficient power to operate the sensing apparatus 2 over a prolonged period of time. If operation of the apparatus will be for a long period of time, e.g. over a year, an additional power source(s) may be provided to ensure continuous uninterrupted operation of the sensing apparatus 2.

Figure 2:
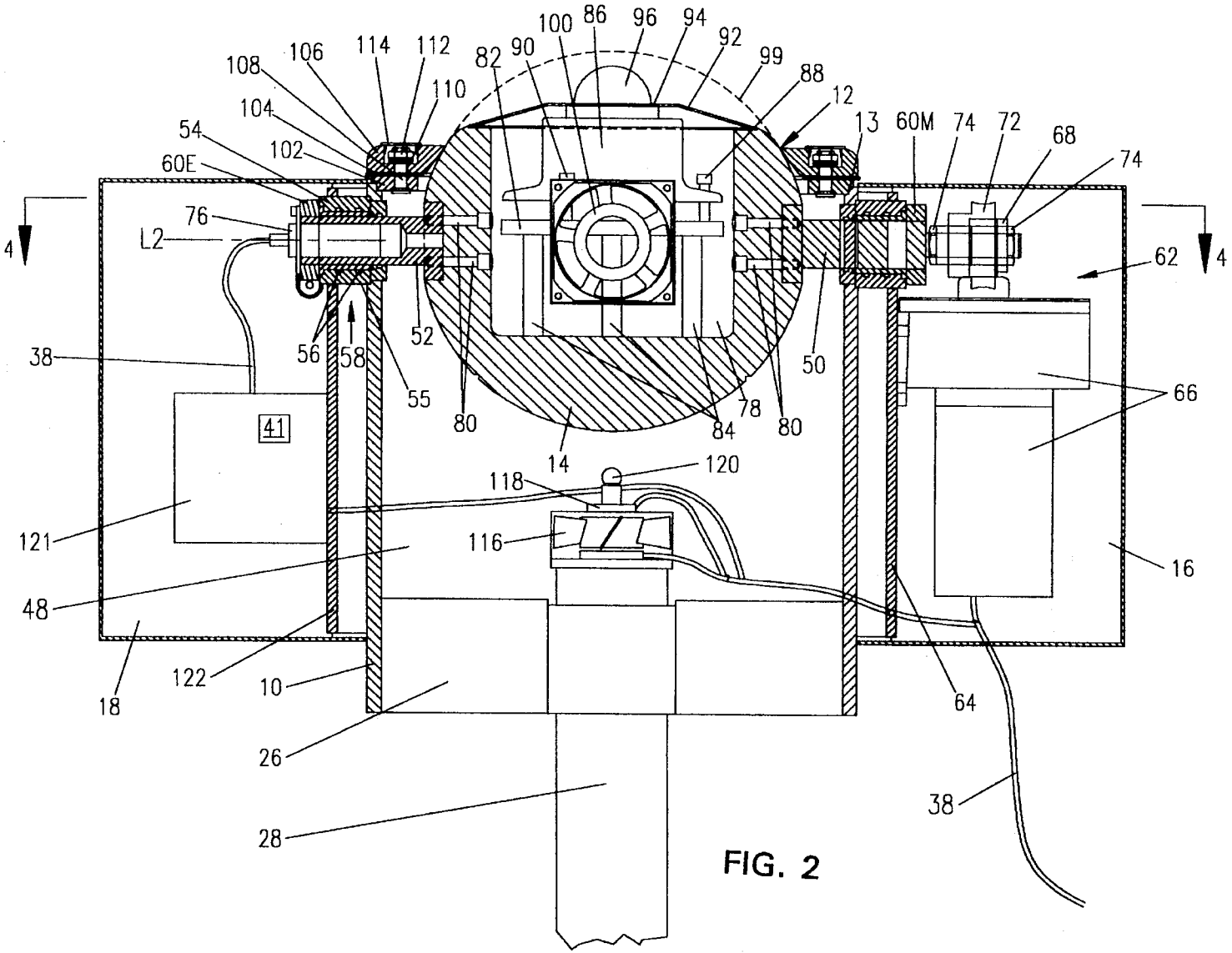
FIG. 2 is a diagrammatic front elevational cross-section view of the housing of the sensing apparatus with the sensor shown in a use position.

As can be seen in FIG. 2, the generally spherically shaped housing 14 is supported within an interior cavity 48 of the cylindrical housing 4. A drive shaft 50 is secured to a first end portion of the generally spherically shaped housing 14, via a plurality of retaining screws 80, and a hollow support shaft 52 is secured to a second opposed end portion of the generally spherically shaped housing 14, via a plurality of retaining screws 80. The hollow support shaft 52 and the drive shaft 50 are axially aligned with one another and together define the rotational axis of the generally spherically shaped housing 14. Remote end portions of the hollow support shaft 52 and the drive shaft 50 support bearings 58 secured, by a conventional fastener, to the cylindrical side surface 10 of the cylindrical housing 4. Each bearing 58 includes a sleeve 54 supported within a bearing housing 55 via a pair of O-rings 56 and is designed to provide a floating action which compensates for misalignments due to manufacturing tolerances, and relieves temperature induced stresses of the mechanical components.

It is to be appreciated that the generally spherically shaped housing 14 may be supported for rotation about its axis of rotation by a unitary drive shaft 50 extending completely through the generally spherically shaped housing 14, rather than separate drive and hollow support shafts 50, 52.

Shaft collars 60M and 60E, mounted on the remote end of the hollow support shaft 52 and the drive shaft 50, respectively, prevent axial movement of the generally spherically shaped housing 14 during rotation, and absorb any thrust loads which may be generated by the drive system 62 during rotation.

Figure 3:
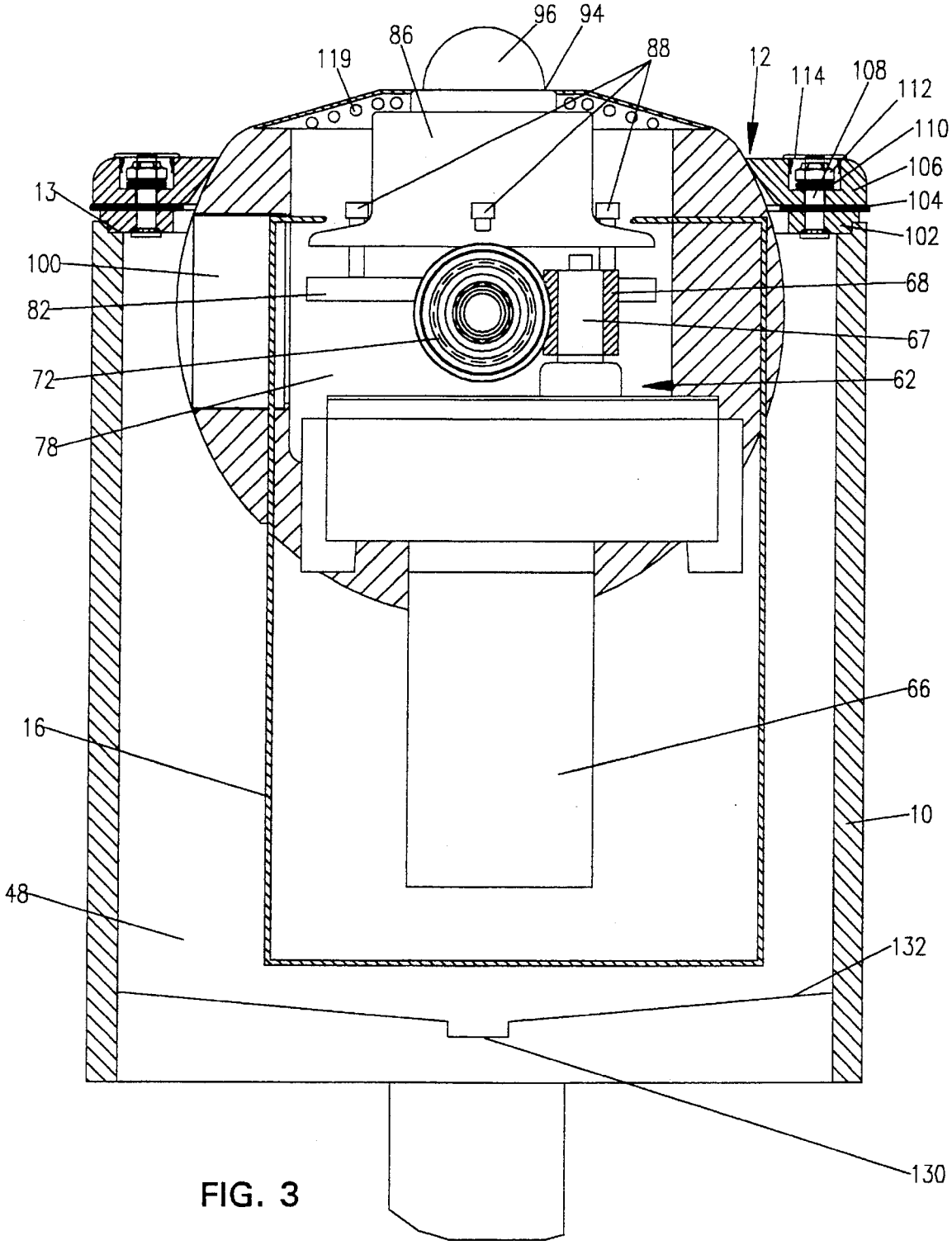
FIG. 3 is a diagrammatic side elevational cross-sectional view of a second embodiment of the sensing apparatus according to FIG. 2.

With reference to FIGS. 2 and 3, a further description concerning the drive system 62, housed within the drive system housing 16, will now be provided. A drive system platform 64 is secured to the cylindrical housing 4 by screws, welding or the like, and a motor 66 is, in turn, secured to the drive system platform 64 by suitable fasteners such as screws, bolts, etc. The motor 66 includes a drive shaft 67 which supports a worm drive gear 68 adjacent a remote end thereof. The worm drive gear 68 meshes with a worm gear 72 which is secured to the drive shaft 50 via locking mechanisms 74, such as Trantorque units or some other similar locking device.

It is to be appreciated that the drive system 62 could comprise a pair of mating bevel gears, rather than a worm drive gear 68 and a worm gear 72 arrangement, or may comprise any other combination of gears which would result in the transmission of rotational energy from the drive shaft 67 of the motor 66 to the drive shaft 50.

The hollow support shaft 52 supports a slip-ring 76 which provides for electrical interfacing of the components, e.g. a fan, the sensor, etc., located within the generally spherically shaped housing 14 with electrical power and facilitates the collection of data by the control system 121. As such electrical interfacing is well known to those skilled in the art, a further detailed description concerning the same is not provided.

The generally spherically shaped housing 14 has a sensor cavity 78, for supporting the sensor 86, as well as any other additional components, e.g. a fan. A generally ring shaped sensor base 82 is supported within the sensor cavity 78 by four adjustable mechanisms 84. The sensor 86 is secured to the sensor base 82 by a plurality of fasteners 88. One or more leveling devices or screws 90 may be provided between sensor 86 and sensor base 82 to allow height and horizontal adjustment of the sensor 86 relative to the generally spherically shaped housing 14. The sensor 86 may, if desired, be pivotally mounted within the sensor cavity 78 and be automatically adjusted, by the computer, to point in a desired direction to obtain the desired measurements. As a variety of pivoting devices are known for pivoting the sensor to ensure accurate positioning for measurement taking, a further detailed description concerning the same is not provided herein. An important feature of the pivot device is that its pivot axis extends normal to the pivot axis L2 of the generally spherically shaped housing 14.

A top portion of the generally spherically shaped housing 14 is truncated or partially removed, to provide an area to accommodate the sensor 86 and a shield 92 which has an aperture 94 provided therein. The shield 92 is supported by the generally spherically shaped housing 14 to separate the sensor cavity 78 from the environment. A sensor dome 96 projects through the aperture 94 of the shield 92. It is important that neither the shield 92, the sensor dome 96 nor any portion of the sensor 86 project outside the generally spherically shaped area, indicated by reference numeral 99 in FIG. 2, defined by the generally spherically shaped housing 14 so as not to interfere with rotation of the sensor 86 between its use and its retracted positions, and vice versa. In a preferred embodiment, the sensor dome 96 is a transparent material such as glass. A suitable sensor incorporating the necessary peripheral components is manufactured by Eppley Laboratory Inc. of Newport, R.I. as part model PSP or Kipp & Zonnnen of Bohemia, N.Y. as model CM21.

A fan 100 is mounted within the sensor cavity 78 to provide a flow of ambient air to the sensor 86 during use. This flow of air escapes the sensor cavity 78 via a space provided between the shield 92 and the sensor dome 96, thereby providing conventional ventilation for the sensor dome 96. Power is supplied to housing ventilation fan 100 via the slip ring 76 and cables (not shown) from the power source 36.

A rectangular, cylindrical or oval shaped flange 102 (FIGS. 2 and 5), depending upon the perimeter shape of the aperture 12 of the cylindrical housing 4, is secured to the first surface 6 of the cylindrical housing 4. A gasket 104 is secured to a top surface of the flange 102. A scraping ring 106 is circumferentially secured about the cylindrical housing aperture 12 on top of the gasket 104 via a plurality of spaced self-clinching studs 108. The scraping ring 106 defines the aperture 12 and is adjustably fastened to be located in close proximity to the exterior surface of the generally spherically shaped housing 14 but spaced therefrom, i.e. the scraping ring 106 and the flange 102 do not contact the exterior surface of the generally spherically shaped housing 14 so as not to interfere with rotation. It is anticipated that the distance between the scraping ring 106 and the exterior surface of the generally spherically shaped housing 14 is of the order of between about 0.001 and 0.010 inches.

In a preferred embodiment, the scraping ring 106, when viewed in cross-section, tapers to a pointed edge and has an impregnated hard coating anodized for ice release. The hard coating can be Teflon®, for example, or any material which will minimize accumulation of contaminants on the exterior surface of the generally spherically shaped housing 14 and an outwardly facing surface of the scraper ring 106. It is to be appreciated that an O-ring may be provided between the scraping ring 106 and the generally spherically shaped housing 14, if desired, to provide a complete seal between those two components but the O-ring must not hinder rotation of the generally spherically shaped housing 14.

Three belleville springs 110 are compressed, via a locknut 112, on each self clinching stud 108. The scraping ring 106 thus floats between the gasket 104 and the belleville springs 110 to compensate for thermal expansion and contraction, maintaining the desired close tolerance between the scraping ring 106 and the exterior surface of the generally spherically shaped housing 14. Plug covers 114 cover the belleville springs 110 to prevent contaminants, e.g. ice, snow, rain, freezing rain, moisture, dirt, or the like, from interfering with proper operation of the belleville springs 110.

The flange 102 is preferably made of aluminum, the gasket 104 is preferably made of rubber, and the studs 108, the belleville springs 110, and the locknut 112 are preferably made of stainless steel.

During rotation of the generally spherically shaped housing 14, any contaminants, e.g. ice, snow, rain, freezing rain, moisture, dirt, or the like, which may have accumulated on the exposed exterior surface of the generally spherically shaped housing 14, engage with a leading edge of the scraping ring 106 and are thereby removed by a scraping action resulting from the relative movement between the exposed exterior surface and the scraping ring 106.

It is to be appreciated that the generally spherically shaped housing 14 may include a plurality of small protrusions and/or indentations on the exterior surface (not shown) to facilitate breaking up and removal of ice, snow, freezing rain, dirt, or the like which may have accumulated on the exposed exterior surface of the generally spherically shaped housing 14.

Figure 5:
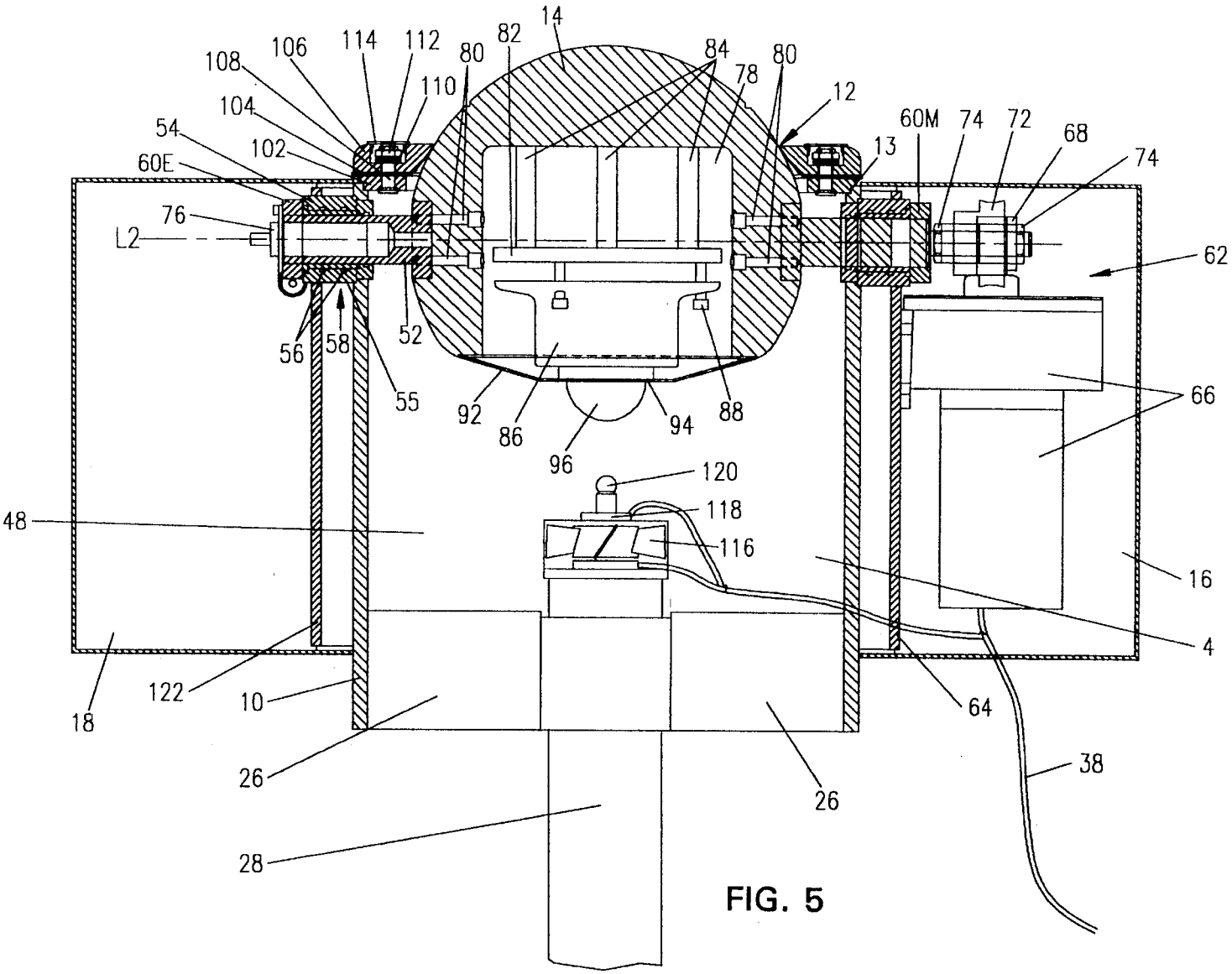
FIG. 5 is a diagrammatic front elevational cross-sectional view of the sensing apparatus in a retracted position.

During use of the sensor apparatus 2, as shown in FIG. 2, the sensor 86 is oriented such that it projects outwardly through the aperture 12 defined by the scraping ring 106. When the sensor 86 is in a retracted position, as shown in FIG. 5, the sensor 86 is totally accommodated within the cylindrical housing 4 and located at a position remote from the aperture 12. When in this position, only a portion of the exterior surface of the generally spherically shaped housing 14, located remote from the sensor 86, is exposed to the environment.

A housing ventilation fan 116 and a heat source 118 are provided within the interior cavity 48 of the housing 4 and are supported by the bracket 26. The heat source 118 is located between the housing ventilation fan 116 and the sensor 86 and/or sensor dome 96 in order to provide heat thereto. The fan 116 and heat source 118 facilitate a flow of warm air over the sensor 86 and/or sensor dome 96. A calibration source 120 is supported by the heat source 118 to provide a source for calibrating the sensor 86, when in its a retracted position, to ensure that the sensor 86 is ready for subsequent data collection. The calibration source 120 is preferably a light source. As such calibration is well known to those skilled in this art, a further detailed description concerning the same is not provided herein.

When the sensor 86 is in its retracted position, the condition of the sensor dome 96 is determined by the control system 121 through the use of the calibration source 120. If the sensor dome 96 is determined by the computer 41 of the control system 121 to be not clean or to be foggy, the housing ventilation fan 116 and/or heat source 118 are activated by the control system 121 to remove, e.g. evaporate, any accumulated ice, snow, rain, freezing rain, or moisture from the sensor dome 96. If desired, a spraying device may be provided within the housing 4 to wash the exterior surface of the sensor dome 96.

In another embodiment, as shown in FIG. 3, the shield 92 supports, on a surface facing the sensor cavity 78, an elongate wire 119, preferably made of NiCr, which typically dissipates 50 watts of power at 12 volt DC to facilitate cleaning of the sensor 86 when in its retracted position.

Typically, the generally spherically shaped housing 14 is capable of being rotated about its rotational axis a full 360 degrees. As the generally spherically shaped housing 14 is rotated, the sensor dome 96 rotates from a use position, where the sensor dome 96 is located substantially completely outside the cylindrical housing 4, to a retracted position where the sensor dome 96 is totally accommodated within the cylindrical housing 4. Such positioning allows the sensor 86 to be completely protected from the external environment and elements. When the sensor 86 is in its retracted position, the exterior surface of the generally spherically shaped housing 14, in combination with the scraper ring 106, seals the aperture 12 to protect the interior cavity 48 from the elements, i.e. only a small clearance is provided between the scraping ring 106 and the exterior surface of the generally spherically shaped housing 14.

Figure 4:
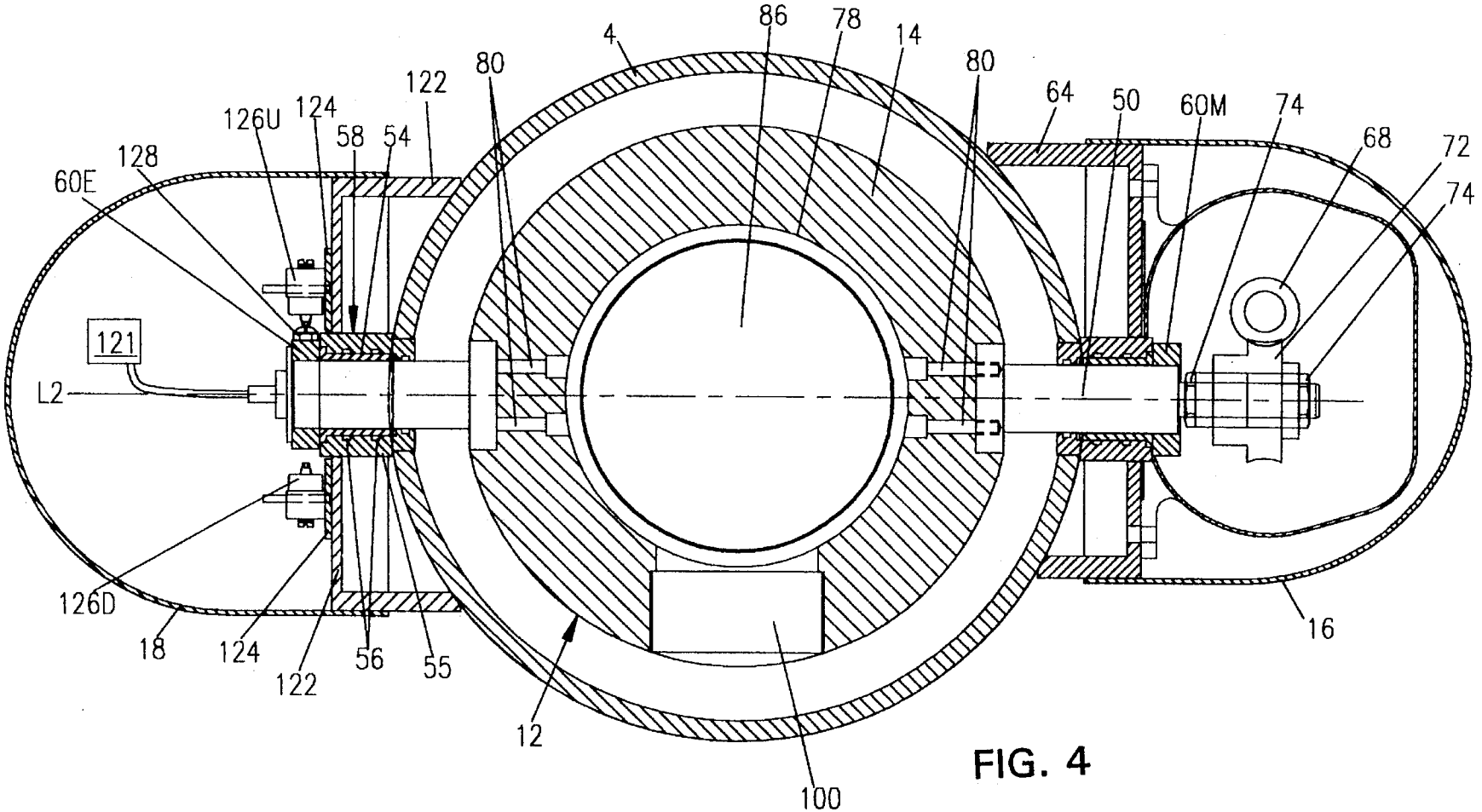
FIG. 4 is a diagrammatic plan cross-sectional view of the sensing apparatus, according to FIG. 2, along section line 4—4.

With reference to FIG. 4 a further detailed description concerning the control system 121 of the present invention will now be provided. A control system platform 122, preferably made of aluminum, is secured by screws, welding or the like to the exterior of cylindrical housing 4, opposite the drive system platform 64. A pair of mounting plates 124 are secured by screws, welding or the like to the control system platform 122 in close proximity to the shaft collar 60E, as shown in FIG. 4.

Limit switches 126U and 126D are secured to the mounting plates 124 in close proximity to the shaft-collar 60E. A projection member 128, such as a round head screw, is secured to the shaft collar 60E, near one end thereof and extends perpendicular to the longitudinal axis L2 defined by the hollow shaft 52. The limit switches are coupled (not shown in detail) to the control system 121 for controlling rotational movement of the generally spherically shaped housing 14. As the generally spherically shaped housing is rotated to its use position and to its retracted position, and vice versa, the projection member 128 contacts one of the limit switches 126U and 126D. Once the contact is made, the limit switch 126U or 126D relays this information to the control system 121 which instructs the motor 66 to stop rotation of the generally spherically shaped housing 14.

The motor 66 is preferably a reversible motor so that if the generally spherically shaped housing 14 cannot rotate in a first direction due to an accumulation of contaminants, e.g. ice, snow, rain, freezing rain, moisture, dirt, soot or the like, the generally spherically shaped housing 14 can be rotated in the opposite direction in an attempt to free the contaminants and permit desired rotation of the generally spherically shaped housing 14. It is preferred that the motor 66 will be rotatable in two directions, to prevent the fan 100 from being exposed to the external environment, and rotate 180 degrees per operation cycle.

In the second embodiment shown in FIG. 3, a drain 130 is provided in a lower surface 132 of the cylindrical housing 4. The lower surface 132 is funnel shaped to assist with channeling of any fluids and/or other contaminants removed from the sensor dome 96 toward the drain 130 for removal from the interior cavity 48. If desired, the drain 130 may be provided with a trap or a suitable one way valve to facilitate removal of the liquid contaminants.

Figure 6:
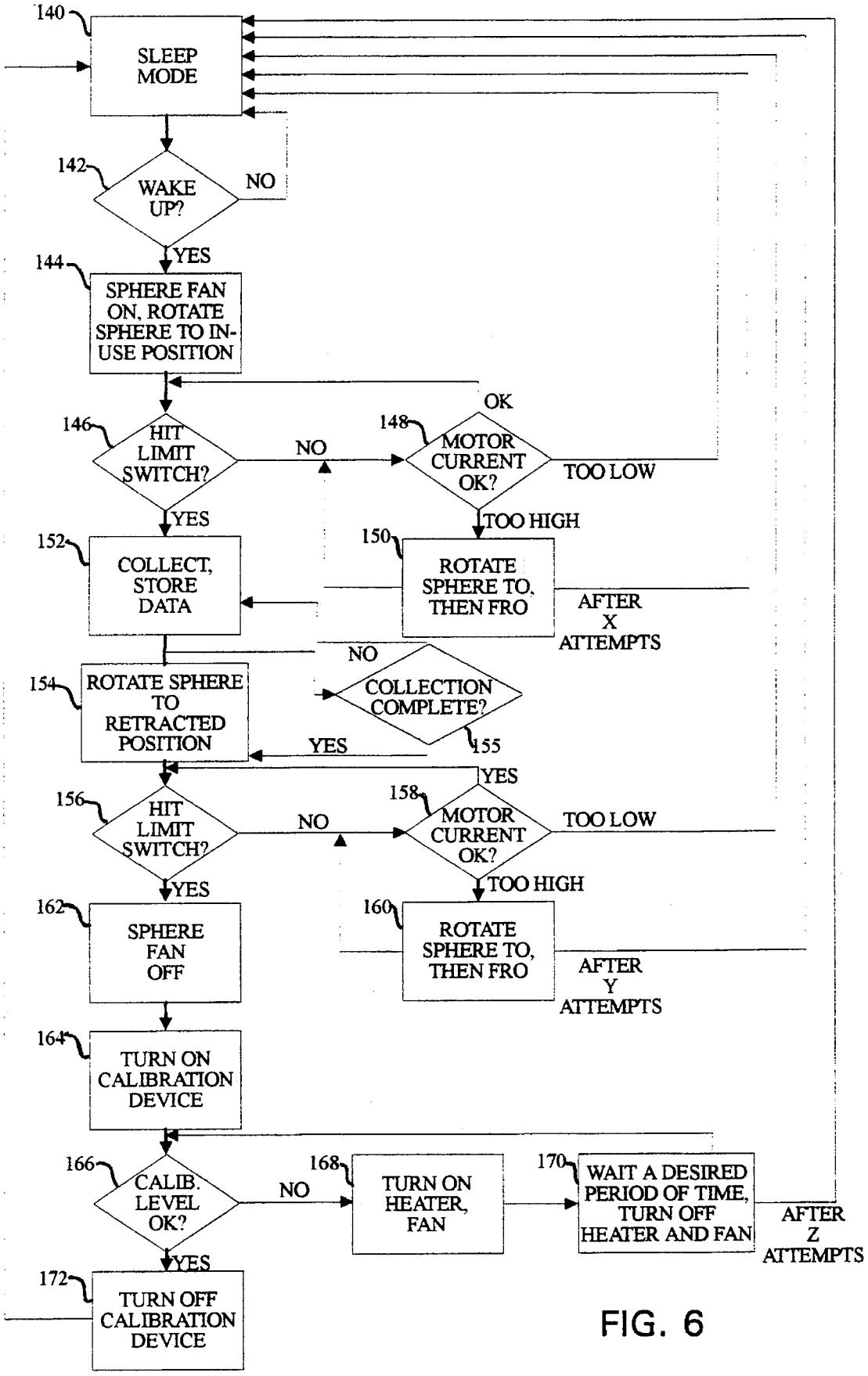
FIG. 6 is a flow chart showing the typical operation of the sensing apparatus.

Turning now to FIG. 6, a flow chart is provided controlling operation of the sensing apparatus 2. At step 140, the control system 121 is in its rest or sleep mode and the sensor 86 is totally accommodated within the cylindrical housing 4 in its retracted position (FIG. 5). At step 142, the computer 41 determines if it is time for the system to be activated or wake up. If the wake up time has not yet occurred the control system 121 returns to the sleep mode at step 140. The computer 41 goes to step 142 preferably once a minute to determine if it is time to wake up. The preferred sleep time is approximately 10 minutes, but either time period may vary depending upon a number of factors, e.g the type of sensor used, the amount of data to be collected, environmental factors and conditions, etc.

When it is determined that the wake up time has been reached, at step 144 the housing ventilation fan 100 is turned on and the motor 66 is activated to commence rotation of the sensor 86 toward its use position.

At step 146, the control system 121 periodically checks if the respective one of the limit switches 126U or 126D has been activated. If not, the motor 66 current is checked at step 148. If the current is within an acceptable range, the limit switch 126U or 126D is checked again. If the current is too low, the control system 121 returns to the sleep mode at step 140. The current may be too low if the battery voltage is too low, or if there is some other problem with the power source 36.

If the current is too high, the generally spherically shaped housing 14 is rotated, at step 150, in an opposite direction slightly, e.g. a few degrees or so, and then rotated back in the original direction slightly, e.g. a few degrees or so, in order to free the generally spherically shaped housing 14 from any contaminants which may be preventing rotation. The motor 66 current is checked again at step 148. This loop of checking the current, and rotating the generally spherically shaped housing 14 slightly in different directions is repeated a desired number of times (X). Preferably the desired number of times (X) is equal to three (3), but this may vary depending upon a number of factors. After the maximum number of attempts is reached and the sensing apparatus 2 is still stuck, the control system 121 returns to the sleep mode at step 140.

Once the limit switch 126U or 126D is activated, the control system 121 at step 152 turns off the motor 66, activates the sensor 86 and commences collection of the data. Step 152 may also include a check of the tilt position of the sensor 86 to see if adjustment of the same is necessary to ensure that the sensor 86 is accurately positioned to collect data. The data obtained by the sensor 86 is stored by the control system 121. The control system 121 checks, at step 155, to determine if the necessary time has elapsed or if the necessary data has been collected. If additional time or data is required the apparatus continues collecting data. Once the necessary data is collected, the motor 66 is activated at step 154 to commence rotation of the sensor 86 toward its retracted position.

At step 156 the control system 121 determines if the respective limit switch 126U or 126D has been activated. If not, the motor 66 current is checked at step 158. If the current is within an acceptable range, the respective limit switch 126U or 126D is checked again at step 158. If the current is too low, the control system 121 returns to the sleep mode at step 140. The current may be too low if, for example, the battery voltage is too low, or there is some other problem with the power source 36.

If the current is too high, the generally spherically shaped housing 14 is rotated, at step 160, in the opposite direction slightly, e.g. a few degrees or so, and then rotated back in the original direction slightly, e.g. a few degrees or so, in an attempt to free the generally spherically shaped housing 14 from any contaminants which may be preventing rotation. The motor 66 current is checked again at step 158. This loop of checking the current, and rotating the generally spherically shaped housing 14 slightly in different directions is repeated a desired number of times (Y). Preferably the number of times (Y) is equal to three (3), but this number may vary from application to application depending upon a number of factors. After the maximum number of attempts is reached and the sensing apparatus is still stuck, the control system 121 returns to the sleep mode at step 140.

If it is determined, at step 156, that the respective limit switch 126U or 126D is activated, the motor 66 and the housing ventilation fan 100 are then turned off at step 162.

At step 164, the calibration device 120 is turned on. At step 166 the calibration of the sensor 86 is checked. If the calibration is not accurate, the heat source 118 and the housing ventilation fan 116 are turned on, at step 168. After waiting a desired amount of time, e.g. thirty (30) seconds, the heat source 118 and the housing ventilation fan 116 are turned off, at step 170, and the calibration is again checked again at step 166.

If the calibration is not acceptable, the heat source 118 and the housing ventilation fan 116 are again turned on, at step 168. This loop of checking the calibration of the sensor 86, turning on and off the heat source 118 and the housing ventilation fan 116, and rechecking the calibration is repeated a desired number of times (Z). Preferably the number of times (Z) is equal to four (4), but this number may vary depending upon a number of factors. After the maximum number of unsuccessful attempts is reached, the control system 121 returns to the sleep mode at step 140.

If the calibration is determined to be acceptable at step 166, the calibration device 120 is turned off, at step 172, and the control system 121 returns to the sleep mode at step 140. The above process continues until the necessary data is collected or a desired time period, i.e. a year, has elapsed.

It is to be appreciated that the sensor 86 may be a radiometer, an infrared sensor, an ozone sensor, a transducer, an electromagnetic radiation sensor, a camera, an ultraviolet sensor, an ultrasonic sensor, an ultrasonic anemometer, a relative humidity sensor, a temperature sensor or any other device for recording or transmitting data concerning the environment or atmosphere. In addition, the dome may be a filter which is selected to allow a desired wavelength of light to pass therethrough or be absorbed thereby. Alternatively, in some applications, the sensor 86 may be exposed directly to the external environment when in its use position.

Since certain changes may be made in the above described sensing apparatus, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, I/we claim:

1. A sensing apparatus for use in adverse conditions, said sensing apparatus comprising:

a main enclosure defining an interior cavity protected from an exterior environment and having an aperture provided in a first surface thereof opening to the environment; and a sensor being supported by a generally spherically shaped housing, said generally spherically shaped housing being larger in size than said aperture and partially extending through said aperture so that at least said sensor is extendible out through said aperture in said main enclosure for obtaining, when in a use position, sensor measurements;

wherein said generally spherically shaped housing is rotatable relative to said aperture and is supported by said main enclosure for rotation about a rotational axis from the use position, in which said sensor is located outside said main enclosure and positioned to obtain desired sensor measurements, to a retracted position in which said sensor is completely accommodated within said interior cavity of said main enclosure; and a drive mechanism is coupled to said generally spherically shaped housing for rotating, as desired, said generally spherically shaped housing to the use position and to the retracted position.

2. A sensing apparatus according to claim 1, wherein said sensing apparatus includes a computer to control rotation of said generally spherically shaped housing and to determine a condition of said sensor.

3. A sensing apparatus according to claim 1, wherein a scraping ring is mounted circumferentially about said aperture, said scraping ring is located adjacent an exterior surface of said generally spherically shaped housing but spaced therefrom for removing, during rotation of said generally spherically shaped housing, contaminants which collect on an exterior surface thereof.

4. A sensing apparatus according to claim 1, wherein an exterior surface of said main enclosure defines a weatherproof interior cavity for sheltering said sensor within said main enclosure from the external environment, when in the retracted position.

5. A sensing apparatus according to claim 1, wherein a heat source is provided within said interior cavity for at least one of heating and drying said sensor when in the retracted position.

6. A sensing apparatus according to claim 1, wherein said generally spherically shaped housing is provided with at least one air supply outlet, located adjacent said sensor, and a fan assembly is coupled to said at least one air supply outlet for supplying a flow of air to said sensor during use of said sensing apparatus.

7. A sensing apparatus according to claim 1, wherein said generally spherically shaped housing defines a generally spherically shaped area, said generally spherically shaped housing is truncated and said sensor partially is supported adjacent the truncation of said generally spherically shaped housing such that said sensor is totally accommodated within said generally spherically shaped area to facilitate rotation of said generally spherically shaped housing.

8. A sensing apparatus according to claim 1, wherein said drive mechanism comprises:

a drive shaft at least partially supporting said generally spherically shaped housing for rotation about the rotational axis;

a motor for rotating said generally spherically shaped housing;

a power source for supplying power to said motor; and a coupling interconnecting said drive shaft with said motor for rotating said generally spherically shaped housing about the rotational axis as desired.

9. A sensing apparatus according to claim 3, wherein said scraping ring is spaced from said exterior surface of said generally spherically shaped housing by a distance of between 0.001 and 0.010 inches.

10. A sensing apparatus according to claim 1, wherein a calibration source is provided within said interior cavity for checking a calibration of said sensor, as desired, when said sensor is in the retracted position.

11. A sensing apparatus according to claim 1, wherein said sensing apparatus is supported by a stand.

12. A sensing apparatus according to claim 1, wherein a fan and heater assembly is provided within said interior cavity for drying said sensor, as desired, when said sensor is in the retracted position.

13. A sensing apparatus according to claim 1, wherein a sensor dome protects said sensor from the environment.

14. A sensing apparatus according to claim 3, wherein a generally spherically shaped surface of said generally spherically shaped housing, located remote from said sensor, in combination with said scraping ring closes said aperture when said sensor is in the retracted position.

15. A sensing apparatus according to claim 1, wherein said generally spherically shaped housing is rotatable at least about 180 degrees about the axis of rotation.

16. A sensing apparatus according to claim 1, wherein said drive mechanism is capable of rotating said generally spherically member in both a clockwise and a counterclockwise direction.

17. A sensing apparatus according to claim 1, wherein said interior cavity is provided with a drain, in a surface of said main enclosure, for removing flowable contaminants from said interior cavity.

18. A method of obtaining sensor measurements in adverse conditions, said method comprising the steps of:

defining an interior cavity, protected from an exterior environment, in a main enclosure, and providing an aperture in a first surface thereof opening to the environment;

supporting a sensor by a generally spherically shaped housing, said generally spherically shaped housing being larger in size than said aperture, and extending said generally spherically shaped housing partially through said aperture, at least said sensor being extendible out through said aperture in said main enclosure for obtaining, when desired, sensor measurements;

spacing said generally spherically shaped housing from said aperture so as to be rotatable relative to said aperture;

supporting said generally spherically shaped housing for rotation about a longitudinal axis;

coupling a drive mechanism to said generally spherical shaped housing for rotating said generally spherically shaped housing as desire;and rotating said generally spherically shaped housing about the longitudinal axis from one of a use position, in which said sensor is located outside said main enclosure to obtain desired sensor measurements, to a retracted position in which said sensor is completely accommodated within said interior cavity of said main enclosure.

19. A method according to claim 18, further comprising the step of:

securing a scraping ring circumferentially about said aperture and locating said scraping ring adjacent an exterior surface of said generally spherically shaped housing but spaced therefrom for removing, during rotation of said generally spherically shaped housing, contaminants which collect on an exterior surface thereof.

20. A sensing apparatus for use in adverse conditions, said sensing apparatus comprising:

a main enclosure defining an interior cavity protected from an exterior environment and having an aperture provided in a first surface thereof opening to the environment; and a sensor being supported by a generally spherically shaped housing, said generally spherically shaped housing being larger in size than said aperture and at least partially extending through said aperture so that at least said sensor is exposed to the exterior environment for obtaining, when in a use position, sensor measurements of the outside environment;

wherein said generally spherically shaped housing is rotatable relative to said aperture and is supported by said main enclosure for rotation about a fixed rotational axis from the use position, in which said sensor is exposed to the exterior environment to obtain desired sensor measurements of the outside environment, to a retracted position in which said sensor is completely accommodated within said interior cavity of said main enclosure; and said sensing apparatus includes an automated control mechanism for rotating said generally spherically shaped housing from the retracted position to the use position and vice versa.

* * * * *